United States Patent [19]

Buchner et al.

[11] Patent Number: 4,971,218

[45] Date of Patent: Nov. 20, 1990

[54] PACKING CONTAINER WITH A TEAR OFF ARRANGEMENT

[75] Inventors: Norbert Buchner, Winnenden; Klaus Domke, Ditzingen, both of Fed. Rep. of Germany

[73] Assignee: Robert Bosch GmbH, Stuttgart, Fed. Rep. of Germany

[21] Appl. No.: 368,340

[22] PCT Filed: Jul. 7, 1988

[86] PCT No.: PCT/DE88/00421

§ 371 Date: Jun. 6, 1989

§ 102(e) Date: Jun. 6, 1989

[87] PCT Pub. No.: WO89/00955

PCT Pub. Date: Feb. 9, 1989

[30] Foreign Application Priority Data

Jun. 8, 1987 [DE] Fed. Rep. of Germany ..... 3726162

[51] Int. Cl.[5] ..... B65D 17/34

[52] U.S. Cl. ..... 220/271; 220/276; 220/359; 220/367; 215/260; 229/120; 229/DIG. 14; 206/628

[58] Field of Search ..... 220/271, 276, 359, 367; 215/260; 229/120, DIG. 14; 206/626, 628

[56] References Cited

U.S. PATENT DOCUMENTS

| | | | |
|---|---|---|---|
| 2,946,502 | 7/1960 | Metzger | 383/84 |
| 3,989,182 | 11/1976 | Stearley | 229/DIG. 14 X |
| 4,126,263 | 11/1978 | Martensson | 229/120 X |
| 4,215,791 | 8/1980 | Brochman | 220/258 |
| 4,261,504 | 4/1981 | Cowan | 220/366 |
| 4,461,420 | 7/1984 | Horvath | 229/120 |
| 4,545,498 | 10/1985 | Schmid | 215/260 |
| 4,762,246 | 8/1988 | Ashley et al. | 220/270 |

OTHER PUBLICATIONS

EP No. 0 104 548, Buchner, et al., Europäische Patentanmeldung, 4/1984.

EP No. 0 129 102, Buchner, et al., Europäische Patentanmeldung, 12/1984.

EP No. 0 209 729, Buchner, et al., Europäische Patentanmeldung, 1/1987.

*Primary Examiner*—Stephen Marcus

*Assistant Examiner*—Nova Stucker

*Attorney, Agent, or Firm*—Michael J. Striker

[57] ABSTRACT

A packing container comprising a tear-off part defined by predetermined lines of weakness and removable from a container wall, and a handle clip connected with a start portion of the tear-off part and comprising an overpressure valve which closes an opening in the container wall.

7 Claims, 2 Drawing Sheets

Fig. 1
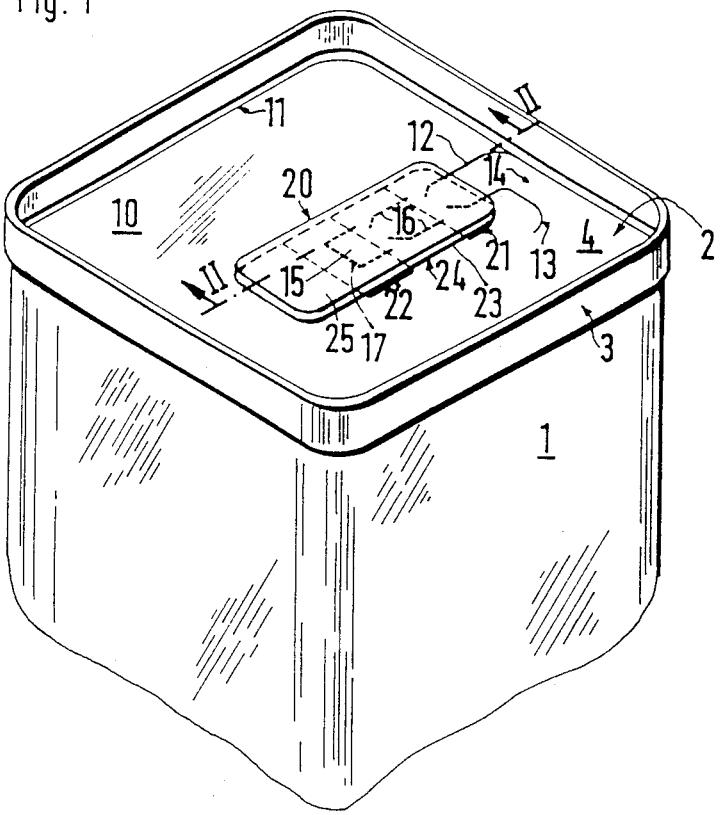
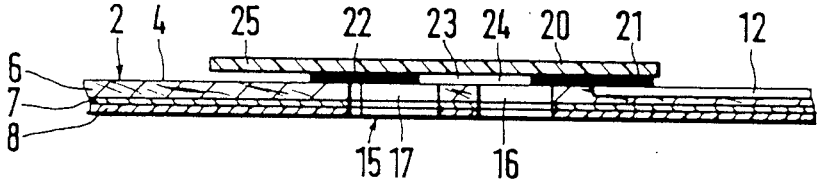
Fig. 2

PACKING CONTAINER WITH A TEAR OFF ARRANGEMENT

BACKGROUND OF THE INVENTION

The invention relates to a packing container comprising a tear-off part defined by lines of weakness and having a starting portion connected with a handle clip. In order to form an opening in a wall of a packing container which is defined in an exact manner with respect to the surface area it is known, e.g. from EP-A-104 548 and EP-A-129 102, to incorporate a predetermined line of weakness, preferably in the upper surface of the cover, in the form of a notch which encloses a tear-off part. A handle clip, whose free end can be easily grasped with the fingers for removing the tear-off part, is connected, as tear-off means, with the narrow start portion of the tear-off part which tapers in the form of a tongue.

In addition, a packing container comprising an overpressure valve is known from EP-A-209 729 which allows gas produced during the storage of the filling material, e.g. carbon dioxide in the case of coffee, to escape so as to prevent the packing container from expanding.

SUMMARY OF THE INVENTION

The object of the invention is to provide a packing container with an overpressure valve which is easy to open and which is constructed in such a way as to economize on material. The object of the invention is achieved by providing a packing container wherein the handle clip is formed as an overpressure valve and closes the container opening.

The packing container, according to the invention, has the advantage that the handle clip and the overpressure valve are integrated in one part. Aside from economizing on material, this design has the additional advantage that the manufacturing of the predetermined line of weakness for the tear-off part and the manufacture of the perforation for the overpressure valve can be effected in a single work step, and the fastening of the combined handle clip/overpressure valve part at the packing container can likewise be effected in a single work step, so that the expenditure on labor in the manufacture of the container is also very low.

The novel features which are considered as characteristic for the invention are set forth in particular in the appended claims. The invention itself, however, both as to its construction so to its mode of operation, together with additional objects and advantages thereof, will be best understood from the following description of preferred embodiments when read in connection with the accompanying drawings.

BRIEF DESCRIPTION OF THE DRAWINGS

FIG. 1 shows a perspective view of a head of a packing container with a tear-off arrangement according to the present invention; FIG. 2 shows a partial cross-sectional view of a cover of the packing container, according to FIG. 1, along line II—II of FIG. 1.

DESCRIPTION OF THE PREFERRED EMBODIMENTS

Figure 3:
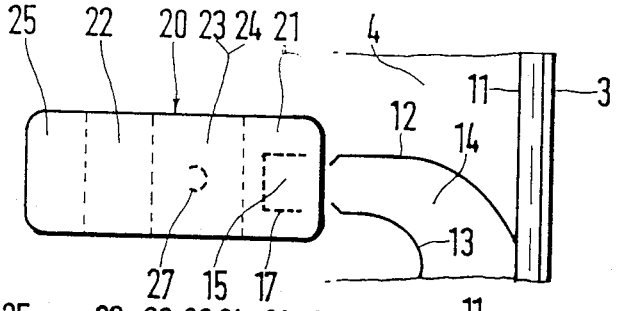
FIGS. 3 and 4 show a top view of two other embodiments of a tear-off arrangement of a packing container according to the invention.

A packing container has a tubular or box-shaped body 1, and its upper opening is closed by a cover 2 which is sealed with the upper end of the body 1 by a U-shaped folded rim 3. The packing container is moisture-proof and gastight and is particularly suitable for packing foodstuffs and semi-luxury items which are sensitive to air and moisture.

The body 1 is formed from a multiple-layer packing material which has a weldable, thermoplastic layer on the inside. In the embodiment shown, the body 1 has a square cross-section with rounded corners; but its cross-sectional shape can also be circular, oval, rectangular or polygonal, wherein the corners are preferably rounded. The cover 2 closing the upper opening of the body 1 has a flat wall 4 and a U-shaped folded rim 3 which defines the latter, is adapted to the cross-sectional shape of the body 1, encloses the end of the body, and is tightly sealed with the inside and outside of the latter. The cover 2 is produced from a multiple-layer composite material which has an outer layer 6 of plastic or cardboard, a middle layer 7 of thin metal foil and an inner layer 8 of a weldable or heat-sealable plastic material.

The packing container has a removable tear-off part 10 in one wall, preferably in the cover 2, which tear-off part 10 is surrounded by a predetermined line of weakness 11 constructed as a notch in the outer supporting layer. In the embodiment shown in FIG. 1, the predetermined line of weakness 11 extends in the flat wall 4 of the cover 2 parallel and in proximity to the edge flange 3, so that the tear-off part 10 provides a full tear-off surface adapted to the upper surface of the cover. A second predetermined line of weakness 12 bends in a straight-edge portion from the predetermined line of weakness 11 toward the center of the cover 2 which, together with an arc-shaped predetermined line of weakness 13 extending approximately parallel to the latter, defines a tear-off tongue 14 with a start portion 15, which tear-off tongue 14 extends toward the center of the cover 2. The predetermined lines of weakness 12, 13, which are constructed as notches or grooves, are interrupted toward the center of the cover 2 and continue as two parallel cuts 16 and a U-shaped cut 17 which defines the start portion 15. The cuts 16 and the U-shaped out 17 penetrate the cover material completely so that the U-shaped start portion 15 can be bent out of the cover surface, and a gas exchange between the interior and exterior of the container is possible through the cuts 17.

In order to close the cuts 16 and 17 acting as openings, as well as to make it easier to lift the start portion 15 out of the cover surface, small plates or strips 20 are fastened on the upper side of the cover 2 over the area of the start portion 15, the cuts 16 and the ends of the predetermined lines of weakness 12 and 13. The strip 20, which has a rectangular shape, consists of a flexible foil, preferably of plastic materials such as polyethylene or polypropylene, and has a thickness of approximately 30 μm. The width of the strip 20 is somewhat greater than the distance of the two cuts 16 from one another and the sides of the U-shaped cut 17. Its length is substantially greater than the distance of the ends of the predetermined line of weakness 12, 13 and the U-shaped cut 17. The strip 20 is connected with the upper side of the cover 2 by means of two adhesive surfaces 21 and 22. The two adhesive surfaces 21 and 22, which extend transversely relative to the longitudinal extension of the strip 20, are at a distance from one another, so that the nonadhesive part 23 of the strip 20 which is situated between them defines a valve channel 24 together with the area of the surface of the cover 2 covered by this part, the cuts 16 opening into this valve channel 24. The end area 25 of the strip 20 situated opposite the end area with the adhesive surface 21 is likewise free of adhesive, so that this end area 25 can be grasped as a handle. The adhesive surfaces 21 and 22 extending transversely relative to the longitudinal extension of the strip 20 comprise a non-curing adhesive, preferably with a polyurethane base.

The cover 2 comprising the predetermined lines of weakness 12, 13 and cuts 16, 17, as well as the strip 20, acts in the following manner:

During the storage of the packing container with the filling material packaged inside it, the flexible strip 20 is fastened so as to lie flat on the upper side of the plane wall 4 of the cover 2. In so doing, it covers the cuts 16 and 17 penetrating the wall 4, so that a connection between the interior of the container and the atmosphere surrounding it is interrupted. The sealing action in the area of the valve channel 24 is further increased if a liquid sealing medium, e.g. silicon oil, is arranged therein. If the packaged filling material produces gas, the pressure increases in the interior of the packing container and is also transmitted into the valve channel 24 through the cuts 16. As the pressure increases in the interior of the container, the nonadhesive portion 23 of the flexible strip 20 which defines the valve channel 24 at the top curves up, so that a connection to the outside is finally created by the expansion of the channel 24. Gas flows out of the interior of the packing container through this expanded valve channel until the pressure has fallen below a predetermined value at which the nonadhesive portion 23 of the strip 20 lies again on the surface of the cover 2, and the silicon oil forms a sealing film. This degassing process, per se, can be repeated several times. It has been shown that the portions of the strip 20 with the adhesive surfaces 21, 22 completely seal the U-shaped cut 17 and the ends of the predetermined line of weakness 12, 13.

The strip 20 also facilitates the opening of the packing container. In order to remove the tear-off part 10 from the cover 2 of the packing container, the nonadhesive end area 25 of the strip 20 is grasped with the fingers and pulled up. In so doing, the adhesive surface 22 adjoining the nonadhesive end area 25 is lifted from the surface of the cover 2, wherein, however, the punched out U-shaped start portion 15 remains adhered to the strip 20 due to low resistance and is raised along with it. When pulled further, the cover material breaks between the sides of the U-shaped cut 17 and the cuts 16 and between the latter and the ends of the predetermined lines of weakness 12 and 13, so that the tear continues into the predetermined lines of weakness 12 and 13 and overlaps the predetermined line of weakness surrounding the tear-off part 10, so that the tear-off part 10 can finally be completely torn out of the cover 2. It is noted with respect to the nature of the adhesive of the adhesive surfaces 21 and 22 of the strip 20 that the adhesive is of the non-curing type and its adhesive properties are adjusted in such a way that it disengages from the plastic upper side of the cover 2 when pulling the strip 20 at an angle, but in such a way that the punched out start portion 15, which is not clamped in, is carried along when pulling away.

Figure 4:
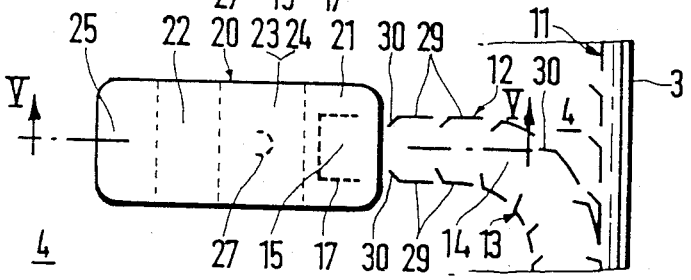

In the embodiments according to FIGS. 3 and 4, the strip 20, which serves as overpressure valve and as handle clip, is constructed in substantially the same way as in the embodiment according to FIG. 1; on the other hand, the opening for the passage of the gas through the cover 2 and the predetermined lines of weakness 12, 13 are constructed in a different manner. In the embodiment according to FIG. 3, the predetermined lines of weakness 12 and 13 defining the tear-off tongue 14 end prior to the strip 20. The sides of the U-shaped cut 17 defining the punched-out start portion 15 adjoin the prolongation of the predetermined lines of weakness 12, 13. The U-shaped cut 17, with the start portion 15, is covered and sealed by the end of the strip 20 with the adhesive surface 21. The gas passage opening into the valve channel 24 is formed by an arc-shaped slot 27 which is covered by the nonadhesive portion 23 of the strip 20. The embodiment according to FIG. 4 is constructed in a manner similar to that according to FIG. 3 with the difference that the predetermined lines of weakness 11, 12, 13 are not constructed as continuous notches or grooves, but, rather, are composed of a plurality of notch segments 29 which comprise angled cuts 30 as catch notches.

The packing container, according to FIGS. 3 and 4, is opened in a manner similar to that described above with reference to FIG. 1. When pulling up the strip 20, which is grasped at the end area 25 which is free of adhesive, the adhesive surface 22 is first detached and as the adhesive surface 21 is detached, the start portion 15 is then drawn along and the continued tear is directed into the predetermined lines of weakness 12, 13. It is noted additionally that the construction of the predetermined lines of weakness 11, 12, 13 from a plurality of notch segments is advantageous particularly in covers whose supporting layer consists of a cardboard.

Figure 5:
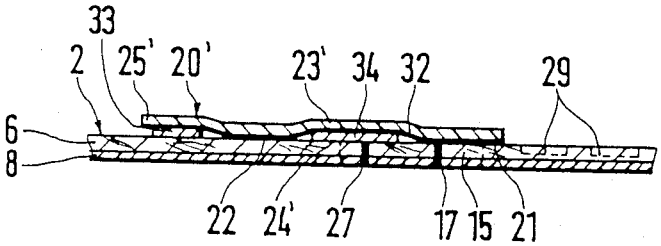
FIG. 5 shows a cross-sectional view along line V—V in FIG. 4 of the tear-off arrangement shown in FIG. 4.

In a modification of the embodiments according to FIGS. 1 to 4, in which the strip 20 forming an overpressure valve and a handle clip is formed from a single-layer foil with an adhesive coat for the adhesive surfaces 21 and 22, which adhesive coat is applied in zones, the strip 20' in the embodiment according to FIG. 5 consists of a foil which is completely coated on the underside with adhesive 32. The nonadhesive zones for the handle end area 25' and the nonadhesive portion 23' for the valve channel 24 are formed by gluing on thin cover strips 33 and 34. These cover strips 33, 34 consist of a flexible plastics foil, e.g. polyethylene, polyester and the like, having a thickness of approximately 10 $\mu$m.

Figure 6:
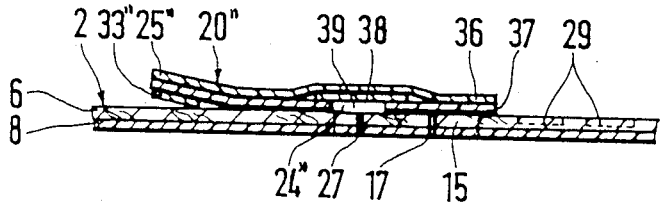
FIG. 6 shows a cross-sectional view of another embodiment of a tear-off arrangement.

The strip 20'' forming an overpressure valve and a handle clip can also be constructed in such a way that the valve function is shifted to the multiple-layer strips 20'' (FIG. 6). The strip 20'' comprises two overlapping strips 36, 37 of flexible plastics foil, the upper strip being coated on its entire underside with an adhesive and connected with the upper side of the lower strip 37, except in the area of the valve channel 24'' to be formed; the adhesive action of the adhesive layer is rendered inactive in the area of the valve channel 24'' by a transversely extending cover strip 38. The lower strip 37 has an opening 39 which is aligned centrally with respect to the cover strip 38 and which lies so as to cover the opening 27 of the wall 4 of the cover 2 when the strip 20'' is fastened on the cover 2. In order to form the nonadhesive handle area 25'', the nonadhesive area 25'' of the strip 37, which is likewise coated with adhesive at its underside along the full surface area, is provided with a cover strip 33''. Moreover, in the embodiments according to FIGS. 5 and 6, the strip 20' and 20" forming an overpressure valve and a handle clip is arranged on the cover 2 of the container in the same manner as in the embodiments according to FIGS. 1 to 4.

While the invention has been illustrated and described with references to specific embodiments of a packing container, it is not intended to be limited to the details shown, since various modifications and structural changes may be made without department in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A packing container comprising a wall having an opening; a tear-off part defined by predetermined lines of weakness, removable from said wall and having a start portion; a handle clip connected with said start portion of said tear-off part for removing said tear-off part from said wall; said handle clip comprising an overpressure valve for closing said opening to provide for removal of excess gas pressure from an interior of said packing container.

2. A packing container according to claim 1, wherein said handle slip includes a flexible strip having a longitudinal extent, a side facing said wall and two adhesive surfaces on said wall-facing side and extending transversely to said longitudinal extent of said flexible strip, one of said two adhesive surfaces being connected with said start portion of said tear-off part; and a valve channel extending between said two adhesive surfaces and between said wall-facing side and said wall and communicating with said opening in said wall of said packing container.

3. A packing container according to claim 2, wherein said handle clip includes a handle end, an adhesive layer completely covering said wall-facing side of said handle clip, and cover strip means for rendering adhesive of said adhesive layer inactive in regions of said handle end and said valve channel.

4. A packing container according to claim 2, wherein said handle clip has an end, said one of said two adhesive surfaces being located between said handle end and said valve channel.

5. A packing container according to claim 1, wherein said handle clip has a handle end and an end opposite to said handle end, said start portion of said tear-off part being connected with said opposite end.

6. A packing container according to claim 1, wherein said predetermined lines of weakness defining said tear-off part adjoin said start portion of said tear-off part and are interrupted.

7. A packing container according to claim 1, wherein said opening in said wall of said packing container is defined by a portion of said lines of weakness which define said start portion of said tear-off part.

* * * * *